US010415278B2

(12) United States Patent
Choi et al.

(10) Patent No.: US 10,415,278 B2
(45) Date of Patent: Sep. 17, 2019

(54) DOOR LATCH DEVICE FOR VEHICLE

(71) Applicants: HYUNDAI MOTOR COMPANY, Seoul (KR); PYEONG HWA AUTOMOTIVE CO., LTD., Daegu (KR)

(72) Inventors: Dong Wuk Choi, Yongin-si (KR); Jong Chul Oh, Daegu (KR); Ki Ryun Ahn, Daegu (KR); Hyuk Noh, Daegu (KR); Jong Ho Park, Daegu (KR)

(73) Assignees: HYUNDAI MOTOR COMPANY, Seoul (KR); PYEONG HWA AUTOMOTIVE CO., LTD., Dalseo-gu, Daegu (KR)

( * ) Notice: Subject to any disclaimer, the term of this patent is extended or adjusted under 35 U.S.C. 154(b) by 654 days.

(21) Appl. No.: 14/722,085

(22) Filed: May 26, 2015

(65) Prior Publication Data

US 2016/0160541 A1 Jun. 9, 2016

(30) Foreign Application Priority Data

Dec. 2, 2014 (KR) ..... 10-2014-0170795

(51) Int. Cl.
*E05B 85/26* (2014.01)
*E05B 77/38* (2014.01)

(52) U.S. Cl.
CPC ..... *E05B 85/26* (2013.01); *E05B 77/38* (2013.01)

(58) Field of Classification Search
USPC ..... 292/200, 201, 216
See application file for complete search history.

(56) References Cited

U.S. PATENT DOCUMENTS 3,504,511 A * 4/1970 Allen ..... E05B 47/0607 292/201
4,172,768 A * 10/1979 Cerdan ..... E05B 85/26 292/216
4,334,704 A * 6/1982 Yamada ..... E05B 79/12 292/216
4,763,936 A * 8/1988 Rogakos ..... E05B 81/14 292/201

(Continued)

FOREIGN PATENT DOCUMENTS

JP 2006-144512 A 6/2006
JP 2013087454 A 5/2013

(Continued)

*Primary Examiner* — Carlos Lugo
(74) *Attorney, Agent, or Firm* — Morgan, Lewis & Bockius LLP

(57) ABSTRACT

A door latch device for a vehicle comprises an operation pawl lever interlocked with a door handle which is mounted on a door, the operation pawl lever configured to rotate; a support pawl lever including a guide hole, and coupled to a rotating shaft that linearly moves along the guide hole, the support pawl lever being pressed in a first direction by the operation pawl lever when the operation pawl lever rotates in a first rotation direction; a claw lever configured to be restricted from rotating by a support part disposed on the support pawl lever, wherein the support pawl lever moves in the first direction when the operation pawl lever presses the support pawl lever to keep the door in a closed state, wherein the support part protrudes in a second direction different from the first direction.

7 Claims, 10 Drawing Sheets

(56) References Cited

U.S. PATENT DOCUMENTS 4,936,611 A * 6/1990 Palvolgyi ..... E05B 83/16 292/216
4,948,183 A * 8/1990 Yamada ..... E05B 81/06 292/199
5,992,194 A * 11/1999 Baukholt ..... E05B 47/0009 292/201
6,007,117 A * 12/1999 Spindler ..... E05B 17/042 292/199
6,485,071 B2 * 11/2002 Schwaiger ..... E05B 83/16 292/216
7,467,816 B2 * 12/2008 Nakagawa ..... E05B 85/26 292/216
8,235,428 B2 * 8/2012 Hunt ..... E05B 85/26 292/216
8,827,329 B2 9/2014 Scholz et al.
9,243,429 B2 * 1/2016 Bendel ..... E05B 77/06
9,534,429 B2 * 1/2017 Spurr ..... E05B 85/26
2006/0119109 A1 6/2006 Nakagawa et al.
2007/0205613 A1 9/2007 Berghahn et al.
2010/0052336 A1 * 3/2010 Bendel ..... E05B 85/26 292/196
2010/0052341 A1 3/2010 Taurasi et al.
2011/0012376 A1 1/2011 Hunt et al.
2014/0001774 A1 * 1/2014 Bendel ..... E05B 77/06 292/200
2014/0035295 A1 2/2014 Bendel et al.
2015/0097379 A1 4/2015 Spurr et al.

FOREIGN PATENT DOCUMENTS

KR 10-0694453 B1 3/2007
KR 10-2007-0046910 A 5/2007
KR 10-2010-0125642 A 12/2010
KR 10-1220394 B1 1/2013
KR 10-2014-0005254 A 1/2014
KR 10-1434980 B1 8/2014

* cited by examiner $$F_{P0} \equiv \mu \times \frac{L_3 \cdot L_1}{L_4 \cdot L_2} F_{SEAL}$$

$$F_{P0} = \mu \times \frac{L_1 \cdot L_3}{L_2 \cdot L_4} \sin(\theta) \cdot F_{SEAL}$$

DOOR LATCH DEVICE FOR VEHICLE

CROSS-REFERENCE TO RELATED APPLICATION

This application claims the benefit of priority to Korean Patent Application No. 10-2014-0170795, filed on Dec. 2, 2014 in the Korean Intellectual Property Office, the entire content of which is incorporated herein in by reference.

TECHNICAL FIELD

The present disclosure relates to a door latch device for a vehicle, and more particularly, to a door latch device for a vehicle that enables a driver or a passenger to open a vehicle door with reduced force.

BACKGROUND

A vehicle door (hereinafter, the term "door" is understood to refer to a vehicle door) may refer to a door opened and closed to allow drivers or passengers to enter and exit a vehicle such as a car.

Vehicle drivers or passengers may operate a door handle with their hands to open the door to enter or exit the vehicle. When the driver or passenger opens the door by operating the door handle with their hands, they apply a predetermined resistance force to the door handle. The resistance force applied to the door handle may be a friction force applied to internal apparatuses.

The related art demonstrates a heretofore unsolved problem in that the size of the resistance force applied to the door handle for the vehicle may be large. Thus, the driver or passenger may often need to apply a larger force than necessary to open the vehicle door due to the resistance force.

SUMMARY

The present disclosure has been made to solve the prior art's above-mentioned problems while maintaining intact the advantages achieved by the prior art.

An aspect of the present disclosure provides a door latch device for a vehicle that enables a driver or a passenger to open a vehicle door with reduced force.

The foregoing and other objects, features, aspects, and advantages of the present disclosure will be understood and readily apparent from the following detailed description of the present disclosure. Also, it is understood that the objects and advantages of the present disclosure are in no way limited by the described embodiments but, on the contrary, is intended to cover various modifications and equivalent arrangements included within the spirit and scope of the appended claims.

According to an embodiment of the present disclosure, a door latch device for a vehicle includes: an operation pawl lever interlocked with a door handle which is mounted on a door, the operation pawl lever configured to rotate; a support pawl lever including a guide hole, and coupled to a rotating shaft that linearly moves along the guide hole, the support pawl lever being pressed in a first direction by the operation pawl lever when the operation pawl lever rotates in a first rotation direction; a claw lever configured to be restricted from rotating by a support part disposed on the support pawl lever, wherein the support pawl lever moves in the first direction when the operation pawl lever presses the support pawl lever to keep the door in a closed state, wherein the support part protrudes in a second direction different from the first direction.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, embodiments of the present disclosure will be described in detail with reference to the accompanying drawings. However, the present disclosure is in no way limited or restricted by the embodiments below.

INVENTIVE EXAMPLE 1

Figure 1:
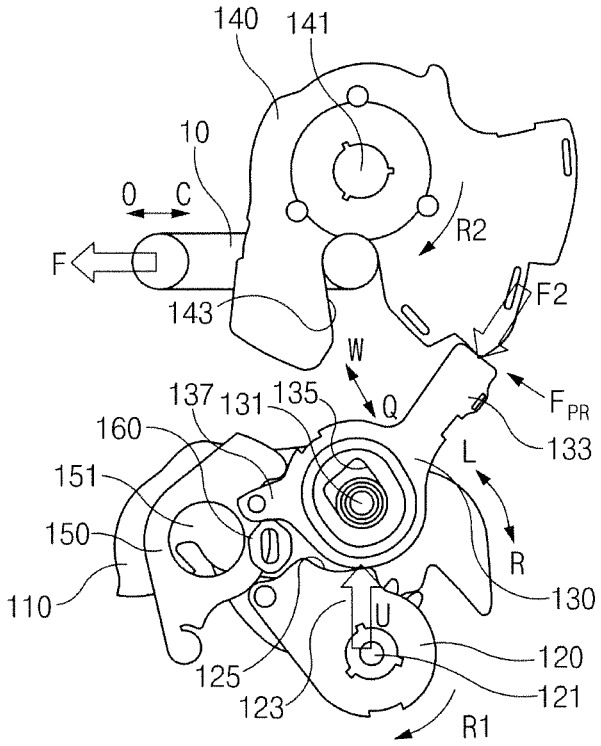
FIG. 1 is a diagram illustrating a door latch device for a vehicle according to Inventive Example 1.

FIG. 1 is a diagram illustrating a door latch device for a vehicle according to Inventive Example 1.

Hereinafter, a door latch device for a vehicle according to Inventive Example 1 will first be described with reference to FIG. 1.

The door latch device for a vehicle according to Inventive Example 1 may include a pawl lifting lever 110, an operation pawl lever 120, a support pawl lever 130, and a claw lever 140.

The pawl lifting lever 110 may be a lever which is operated by interlocking it with a door handle (not illustrated) mounted on a door and used to open and close a vehicle compartment. The pawl lifting lever 110 may rotate in one direction R or the other direction L depending on the operation of the door handle.

The operation pawl lever 120 may be interlocked with the pawl lifting lever 110. The pawl lifting lever 110 and the operation pawl lever 120 may interlock to transfer a rotating force from one to the other. In this way, in a principle similar to tooth wheels which rotate when engaged with each other, the pawl lifting lever 110 and the operation pawl lever 120 may rotate in opposing directions to each other.

That is, when the pawl lifting lever 110 rotates counterclockwise, the operation pawl lever 120 may rotate clockwise. Further, when the pawl lifting lever 110 rotates clockwise, the operation pawl lever 120 may rotate counterclockwise. The operation pawl lever 120 may rotate in an opposite direction to a rotation direction of the pawl lifting lever 110.

While the door latch device described above may operate with the operation pawl lever 120 interlocking with the pawl lifting lever 110, the operation pawl lever 120 may be a lever interlocking with the door handle mounted on the door to open and close the vehicle compartment itself. That is, the operation pawl lever 120 may rotate while being directly connected to the door handle, independent of the pawl lifting lever 110.

The operation pawl lever 120 may be a lever which functions to move the support pawl lever 130 along a guide hole 135 described below. The operation pawl lever 120 may include a pressing part 123 which presses the support pawl lever 130 in a direction U away from the operation pawl lever 120 when rotating in one direction R1.

The pressing part 123 may be provided with a pressing part surface 125 which corresponds to a surface of the support pawl lever 130. With these corresponding surfaces, a smoother pressure may be applied.

The support pawl lever 130 includes the guide hole 135. The support pawl lever 130 may be coupled with a rotating shaft 131 to linearly move along the guide hole 135. In this configuration, the support pawl lever 130 may rotate around the rotating shaft 131 and at the same time may linearly move along the guide hole 135. The linear movement along the guide hole 135 may be defined as movement in a W direction or a Q direction.

When the operation pawl lever 120 presses the support pawl lever 130 in the direction U away from the operation pawl lever 120 while rotating in the direction R1, the support pawl lever 130 may move in the W direction along the guide hole 135. When the pressing force in the U direction by the operation pawl lever 120 disappears, the support pawl lever 130 may move in the Q direction.

The claw lever 140 may be a lever which is supported by the support part 133 which is disposed on the support pawl lever 130 and thus is restricted from rotating to keep a door in a closed state. The claw lever 140 is provided with an insertion groove 143, and thus a striker 10 may be inserted into the insertion groove 143, with the striker 10 fixed to a vehicle body on which the door is mounted.

When the claw lever 140 is restricted from rotating and the striker 10 is coupled with the claw lever 140 with the striker 10 inserted into the insertion groove 143, the door may remain in a closed state.

However, if the claw lever 140 rotates in a direction R2, the striker 10 will be separated from the insertion groove 143 and when the claw lever 140 is separated from the striker 10, the door will open.

The striker 10 illustrated in FIG. 1 may be an apparatus which is fixed to the vehicle body and thus does not move when the door is opened and closed. The moving apparatus may be the door latch device for a vehicle according to Inventive Example 1 including the claw lever 140.

However, for convenience of explanation, the present disclosure will be described under the assumption that the striker 10 moves in an O direction (opening direction) when the door is opened or a C direction (closing direction) when the door is closed.

In the state in which the support pawl lever 130 moves in the W direction, the claw lever 140 is supported by the support part 133 disposed on the support pawl lever 130 and thus may be restricted from rotating. Therefore, the door may be kept in the closed state.

In this state, the support part 133 may protrude in a direction different from the direction (U direction) in which the operation pawl lever 120 presses the support pawl lever 130.

The door latch device for a vehicle according to Inventive Example 1 has the above configuration, thereby allowing a driver or passenger to open the vehicle door with reduced force.

This will be described in more detail below. Shielding rubber is disposed on an edge of the vehicle door. When the door is closed, the shielding rubber prevents foreign material such as rain, snow, or dust from penetrating into a vehicle. The shielding rubber may be an elastomer having elasticity and may be fitted between the door and the vehicle with strong pressure. Therefore, a reaction force (door reaction force) must be applied to the door in an opening direction when the door is in the closed state.

For convenience of explanation, it is assumed in the present disclosure that the striker 10 moves, and therefore the door reaction force may be represented by F in FIG. 1. The striker applies the force F in a state in which the door is closed. The force F is applied to the claw lever 140, forcing the claw lever 140 to rotate in the R2 direction. At the same time, the claw lever 140 is restricted by the support part 133 of the support pawl lever 130 not to rotate and therefore the claw lever 140 applies the reaction force of F2 to the support part 133.

To open the door, there is a need for an operation force to move the support part 133 over a friction force $F_{pr}$ between the claw lever 140 and the support part 133 which is generated by the force (vertical drag) of F2 applied to the support part 133.

In the case of intending to move the support part 133 by direct pressure, the operation force must be as large as the friction force $F_{pr}$. However, the door latch device for a vehicle according to Inventive Example 1 allows the operation pawl lever 120 to rotate the operation pawl lever 120 so as to move the support part 133, thereby opening the door with less operation force than the friction force $F_{pr}$.

Hereinafter, the operation process of the door will be described in detail with reference to the accompanying drawings.

Figure 2:
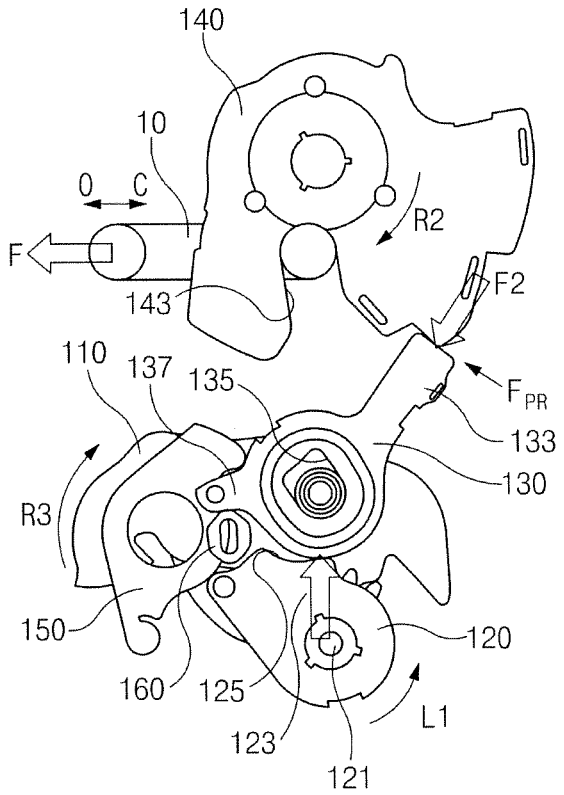
FIG. 2 is a diagram illustrating the door latch device for a vehicle according to Inventive Example 1 which is in an initial opening state.
Figure 3:
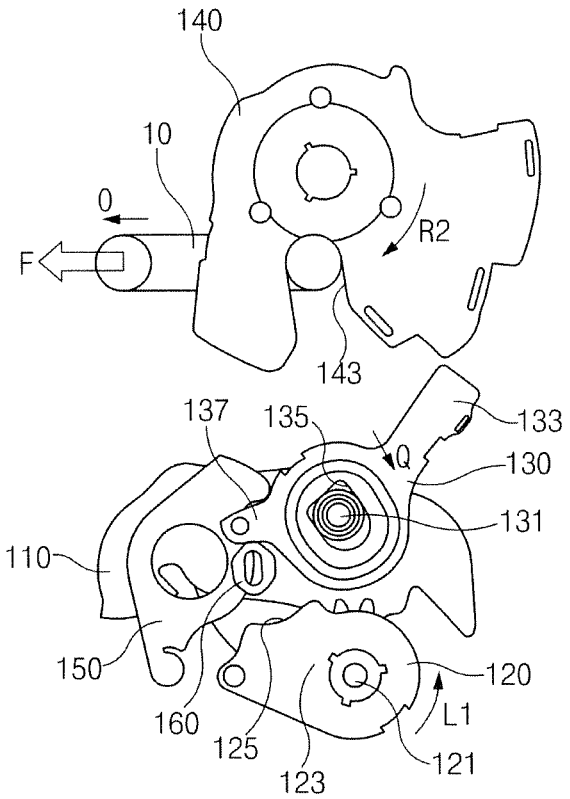
FIG. 3 is a diagram illustrating the door latch device for a vehicle according to Inventive Example 1 which is in an intermediate opening state.
Figure 4:
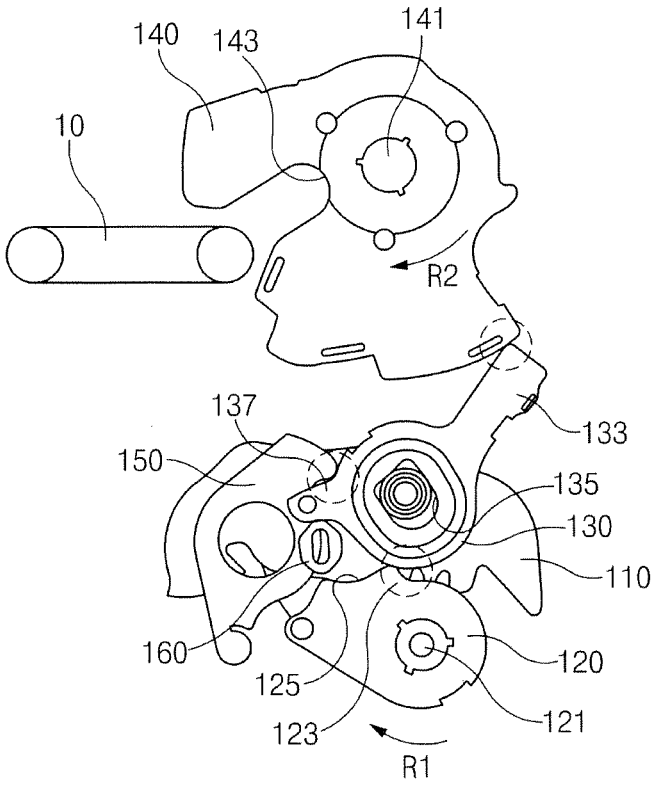
FIG. 4 is a diagram illustrating the door latch device for a vehicle according to Inventive Example 1 which is in a terminal opening state.

FIG. 2 is a diagram illustrating the door latch device for a vehicle according to Inventive Example 1 which is in an initial opening state. FIG. 3 is a diagram illustrating the door latch device for a vehicle according to Inventive Example 1 which is in an intermediate opening state. FIG. 4 is a diagram illustrating the door latch device for a vehicle according to Inventive Example 1 which is in a terminal opening state.

An operation process of opening the door by the door latch device for a vehicle according to Inventive Example 1 will be described with reference to FIGS. 2 to 4.

In FIG. 1, which illustrates an initial closed state, the operation pawl lever 120 supports a lower portion of the support pawl lever 130 and therefore the door latch device according to Inventive Example 1 may be in the closed state without moving.

Referring to FIG. 2, which illustrates an initial opening state, the pawl lifting lever 110 rotates in one direction (R3 direction) when the door handle is operated and the operation pawl lever 120 rotates in the other direction (L1 direction). At the early stage of the operation, the operation pawl lever 120 and the support pawl lever 130 are in the closed state.

Referring to FIG. 3 which illustrates an intermediate opening state, when the door handle is sufficiently pulled, the operation pawl lever 120 sufficiently rotates in the other direction (L1 direction) and thus does not support the support pawl lever 130 any more. In this case, the support pawl lever 130 which is applied with the reaction force of the claw lever 140 moves in the Q direction by being pushed downward along a guide direction of the guide hole 135 of the rotating shaft. The Q direction may be a direction approaching the operation pawl lever 120.

Referring to FIG. 4, which illustrates a terminal opening state, when the support pawl lever 130 moves sufficiently downward, the claw lever 140 is no longer supported by the support part 133 and is released from a confinement of the support pawl lever 130 to rotate in the R2 direction which is an opening direction of the door, thereby opening the door.

In FIG. 4, the striker 10 is separated from the insertion groove 143 and thus the claw lever 140 and the striker 10 are separated from each other. Even after the door is opened, the claw lever 140 keeps rotating in the R2 direction. This is because the claw lever 140 is provided with a spring and thus a force is applied such that it rotates in the R2 direction.

When the door handle returns to an original position in the state in which the door is opened, the operation pawl lever 120 pushes up the support pawl lever 130 while returning to the initial position. The pawl lifting lever 110 is provided with a restoring spring and therefore returns to an original position when the door handle returns to an original position and the operation pawl lever 120 moves with interlocking with the pawl lifting lever 110 and therefore tries to return to an original position when the door handle returns to an original position (R1 direction).

When the operation pawl lever 120 pushes up the support pawl lever 130, the support pawl lever 130 stops without being pushed up due to the contact with the claw lever 140.

The door latch device for a vehicle according to Inventive Example 1 may further include a pawl spring lever 150. The pawl spring lever 150 may be a lever which applies a rotating force to the support pawl lever 130 so that the support part 133 of the support pawl lever 130 moves in a direction approaching the rotating shaft 141 of the claw lever 140. The support pawl lever 130 may include a protrusion 137 which protrudes in a direction opposite to a direction in which the support part 133 protrudes. The pawl spring lever 150 may apply a rotating force to the support pawl lever 130 through the protrusion 137.

The support pawl lever 130 may stop without being pushed up due to contact with the claw lever 140 when a force is applied to return it to the initial position by the operation pawl lever 120 and the pawl spring lever 150.

The door latch device for a vehicle according to Inventive Example 1 may be further provided with a damper 160 to suppress noise occurring when the support pawl lever 130 moves. The damper 160 may also serve to guide the movement of the support pawl lever 130 in addition to preventing noise.

Figure 5:
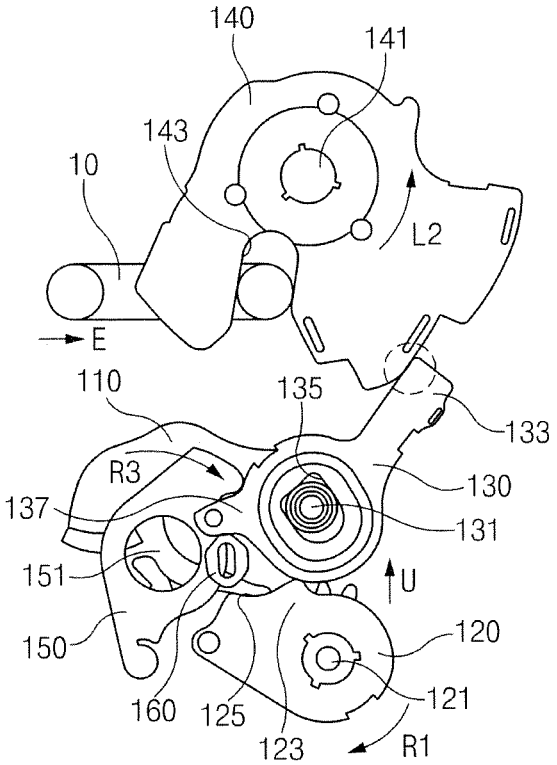
FIG. 5 is a diagram illustrating the door latch device for a vehicle according to Inventive Example 1 which is in an initial closed state.
Figure 6:
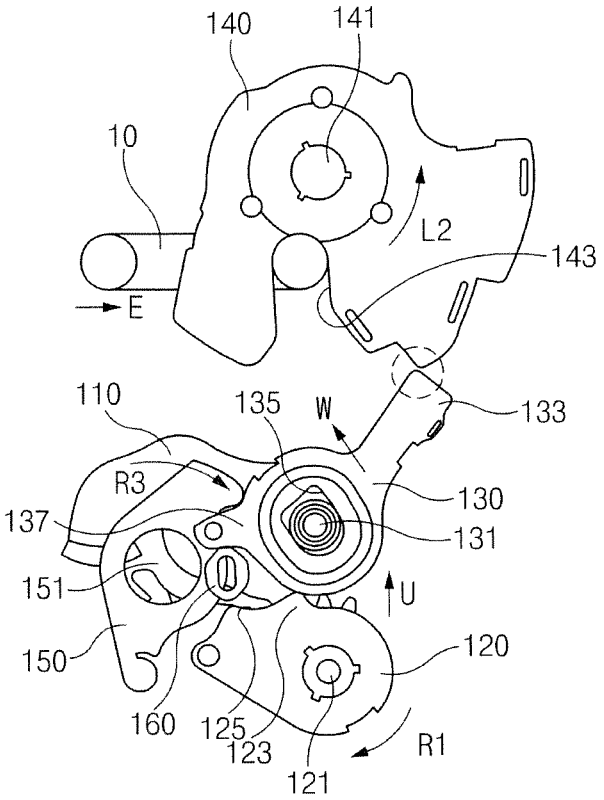
FIG. 6 is a diagram illustrating the door latch device for a vehicle according to Inventive Example 1 which is in an intermediate closed state.
Figure 7:
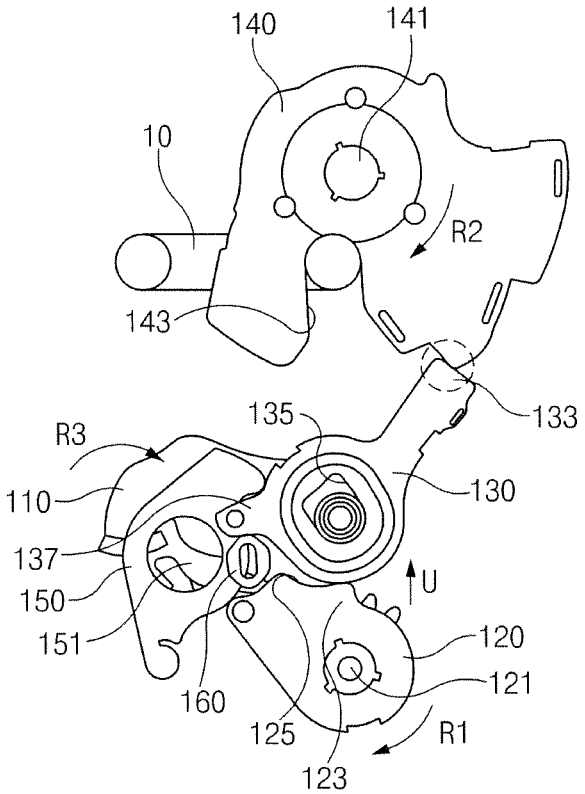
FIG. 7 is a diagram illustrating the door latch device for a vehicle according to Inventive Example 1 which is in a terminal closed state.

FIG. 5 is a diagram illustrating the door latch device for a vehicle according to Inventive Example 1 which is in an initial closed state. FIG. 6 is a diagram illustrating the door latch device for a vehicle according to Inventive Example 1 which is in an intermediate closed state. FIG. 7 is a diagram illustrating the door latch device for a vehicle according to Inventive Example 1 which is in a terminal closed state.

Hereinafter, an operation process of closing the door by the door latch device for a vehicle according to Inventive Example 1 will be described with reference to FIGS. 5 to 7.

FIGS. 5 to 7 sequentially illustrate the initial closed state, an intermediate closed state, and a terminal closed state.

Referring to FIGS. 5 to 7, when the door is closed, the striker 10 moves in an E direction. The striker 10 moving in the E direction is inserted into the insertion groove 143 of the claw lever 140 and continues moving in the E direction.

The claw lever 140 rotates in an L2 direction by the striker 10 which applies force in the E direction while being inserted into the insertion groove 143.

When the claw lever 140 rotates in the L2 direction by the striker 10 to be in the state illustrated in FIG. 7, the support pawl lever 130 contacting the claw lever 140 is pressed by the operation pawl lever 120 and thus moves toward the claw lever 140.

That is, the operation pawl lever 120 presses the support pawl lever 130 in the direction U away from the operation pawl lever 120 while rotating in one direction R1, and thus the support pawl lever 130 may move in the W direction along the guide hole 135 and the support pawl lever 130 may move to an original closed position. In this process, the pawl spring lever 150 rotates in the R3 direction and applies the rotating force to the support pawl lever 130, and thus the support part 133 of the support pawl lever 130 may rotatably move in a direction approaching the rotating shaft 141 of the claw lever 140. Therefore, the support part 133 may move toward the closed position which may support the claw lever 140.

After the door is completely closed, the striker 10 which stops proceeding in the E direction is applied with the door reaction force (see F of FIG. 1), and thus the claw lever 140 again applies a force rotating in the R2 direction to the support part 133. In this case, the support part 133 restricts the rotation of the claw lever 140 similar to the initial closed state to keep the door in the closed state.

[Quantitative Description Based on Force Balance Relationship Equation]

Figure 8:
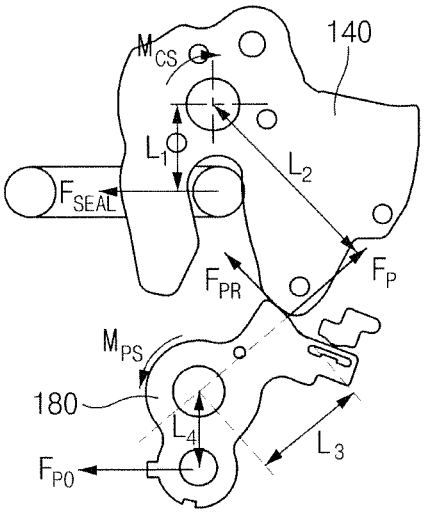
FIG. 8 is a diagram illustrating a force balance relationship of a door latch device for a vehicle according to Comparative Example.

FIG. 8 is a diagram illustrating a force balance relationship of a door latch device for a vehicle according to Comparative Example.

Referring to FIG. 8, when the door reaction force is set to be $F_{seal}$ and a force (operation force) required to make drivers or passengers open the door is set to be $F_{po}$, a relationship equation between $F_{seal}$ and $F_{po}$ may be obtained by using a force balance relationship and a torque balance relationship.

In detail, arranging the three equations of $F_{seal} \times L_1 = F_p \times L_2$ - - - (1), $F_{po} \times L_4 = F_{pr} \times L_3$ - - - (2), $F_{pr} = F_p \times \mu$ (friction coefficient) - - - (3), the relationship equation between $F_{seal}$ and $F_{po}$ may be derived as illustrated in FIG. 8.

In this equation, the operation force $F_{po}$ may be a force which is required to rotate the pawl lever over the friction force $F_{pr}$ generated by the reaction force $F_p$ that the claw lever 140 applies to the pawl lever 180 by the door reaction force $F_{seal}$.

Figure 9:
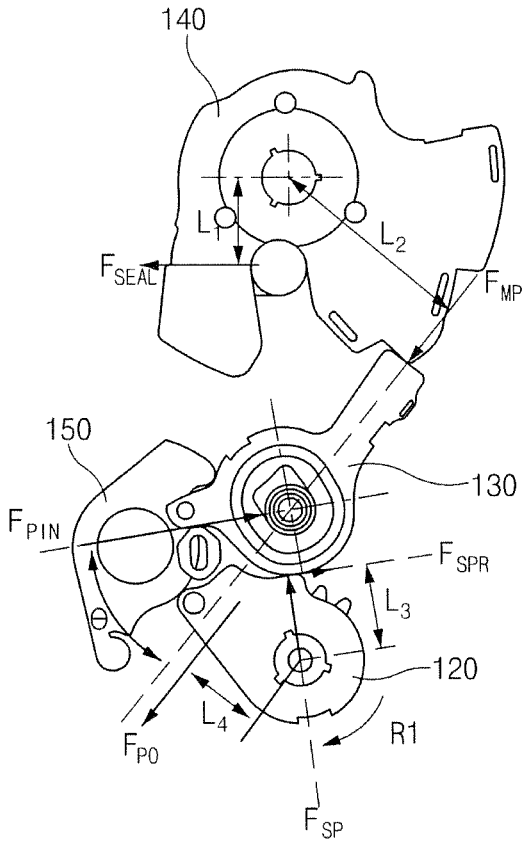
FIG. 9 is a diagram illustrating a force balance relationship of the door latch device for a vehicle according to Inventive Example 1.

FIG. 9 is a diagram illustrating a force balance relationship of the door latch device for a vehicle according to Inventive Example 1.

In FIG. 9, when the door reaction force is set to be $F_{seal}$ and a force (operation force) required to make drivers or passengers open the door is set to be $F_{po}$, the relationship equation between $F_{seal}$ and $F_{po}$ may be obtained by using the force balance relationship and the torque balance relationship like the method illustrated in FIG. 8.

Comparing the relationship equations obtained by FIGS. 8 and 9, the operation force $F_{po}$ by the door latch device according to Inventive Example 1 of FIG. 9 may be smaller by a ratio of sin θ than the operation force $F_{po}$ obtained by Comparative Example shown in FIG. 8.

For example, when θ is 19.471°, sin θ is about ⅓ and therefore the operation force $F_{po}$ according to Inventive Example 1 may be smaller by ⅓ compared to the operation force $F_{po}$ according to Comparative Example. This means that passengers or riders may open the same door with a force reduced by ⅓.

This is because the operation force $F_{po}$ needed to open the door is reduced when the reaction force of $F_{MP}$ is dispersed into two forces of $F_{PIN}$ and $F_{sp}$ (see FIG. 9). Further, the reason the forces are dispersed is that the operation pawl lever 120 is additionally applied to the support pawl lever 130 and the support part 133 protrudes in a direction different from the direction $F_{sp}$ in which the operation pawl lever 120 presses the support pawl lever 130 to support the claw lever 140.

INVENTIVE EXAMPLE 2

Figure 10:
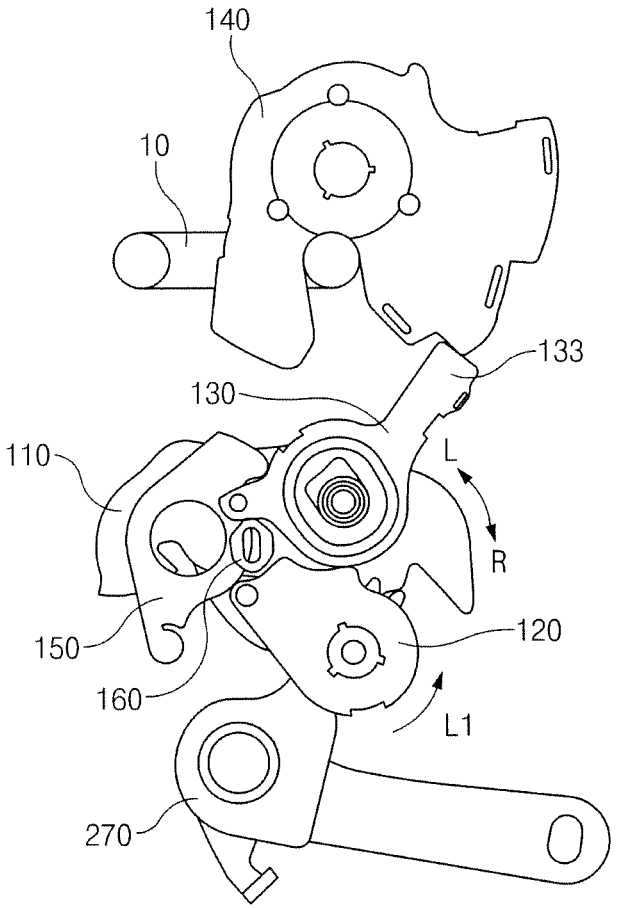
FIG. 10 is a diagram illustrating a door latch device for a vehicle according to Inventive Example 2.

FIG. 10 is a diagram illustrating a door latch device for a vehicle according to Inventive Example 2.

A door latch device for a vehicle according to Inventive Example 2 has a similar configuration to the door latch device for a vehicle according to Inventive Example 1 as described above. However, Inventive Example 2 is different from Inventive Example 1 in that the door latch device for a vehicle further includes an out lever. For reference, the same (corresponding) reference numerals will be used to describe the same (or corresponding) components as the above-mentioned components. In addition, a detailed description of the same components as the above-mentioned components will be omitted.

Hereinafter, the door latch device for a vehicle according to Inventive Example 2 will be described with reference to FIG. 10.

Referring to FIG. 10, the door latch device for a vehicle according to Inventive Example 2 may further include an out lever 270.

The out lever 270 is a lever operated by interlocking with an outside handle (not illustrated) which is positioned outside the door and when the out lever 270 is operated, the pawl lifting lever 110 may rotate. The out lever 270 may be a lever using the outside handle and the pawl lifting lever 110.

The door latch device for a vehicle according to Inventive Example 2 further includes the out lever 270 and thus one door latch device may be operated by using the door handle which is disposed inside the vehicle and the outdoor side handle which is disposed outside the vehicle, respectively.

A passenger outside the vehicle may manipulate the outside handle to open the vehicle. When the out lever 270 is operated by pulling the outside handle, the pawl lifting lever 110 may rotate in an R direction. The pawl lifting lever 110 rotating in the R direction may rotate the operation pawl lever 120 in the L1 direction to perform the operation of opening the door. The operation of opening the door after the operation pawl lever 120 is the same as Inventive Example 1 and therefore the description thereof will be omitted herein.

As described above, according to the exemplary embodiments of the present disclosure, the door latch device for a vehicle includes the operation pawl lever, the support pawl lever which is pressed in the first direction far away from the operation pawl lever when the operation pawl lever rotates in one direction to move along the guide hole, and the M claw lever which is supported by the support part mounted in the support pawl lever to restrictively rotate so as to keep the door in a closed state and the support part protrudes in the direction different from the direction in which the support pawl lever moves along the guide hole, thereby opening the vehicle door with less force.

Although the present disclosure has been described with reference to multiple embodiments and the accompanying drawings, it will be appreciated by those of skill in the art that the present disclosure is not limited to the disclosed embodiments but, on the contrary, various modifications and alterations are included within the scope defined by the appended claims and their equivalents.

What is claimed is:

1. A door latch device for a vehicle, comprising:

an operation pawl lever configured to rotate;

a support pawl lever including a guide hole, and coupled to a rotating shaft so as to linearly move along the guide hole, the support pawl lever being pressed in a first direction by the operation pawl lever when the operation pawl lever rotates in a first rotation direction;

a claw lever configured to be restricted from rotating by a support part disposed on the support pawl lever, wherein the support pawl lever moves in the first direction when the operation pawl lever presses the support pawl lever to keep the door in a closed state; and a pawl spring lever applying a rotating force to the support pawl lever such that the support part of the support pawl lever moves in a direction approaching a rotating shaft of the claw lever, wherein the support part protrudes in a second direction different from the first direction, the operation pawl lever has a pressing part which presses the support pawl lever when the operation pawl lever rotates in the first rotation direction, the pressing part includes a pressing part surface corresponding to a surface of the support pawl lever, and when the operation pawl lever rotates in a second rotation direction, the support pawl lever moves along the guide hole in a third direction towards the operation pawl lever so that the claw lever is no longer restricted from rotating by the support part.

2. The door latch device for a vehicle according to claim 1, wherein the claw lever includes an insertion groove into which a striker fixed to a vehicle body may be inserted.

3. The door latch device for a vehicle according to claim 1, wherein the pawl spring lever applies a force to a protrusion of the support pawl lever.

4. The door latch device for a vehicle according to claim 1, further comprising: a damper for suppressing noise occurring when the support pawl lever moves.

5. The door latch device for a vehicle according to claim 1, wherein the operation pawl lever couples to a pawl lifting lever which couples with the door handle and rotates in a direction opposite to a rotation direction of the pawl lifting lever.

6. The door latch device for a vehicle according to claim 5, wherein the pawl lifting lever and the operation pawl lever interlock with each other to transfer a rotating force.

7. The door latch device for a vehicle according to claim 5, wherein an out lever rotates the pawl lifting lever and the out lever couples to an outside handle disposed outside the door.

* * * * *